US008438851B1

(12) United States Patent
Uhm et al.

(10) Patent No.: US 8,438,851 B1
(45) Date of Patent: May 14, 2013

(54) COMBUSTOR ASSEMBLY FOR USE IN A TURBINE ENGINE AND METHODS OF ASSEMBLING SAME

(75) Inventors: Jong Ho Uhm, Simpsonville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/342,303

(22) Filed: Jan. 3, 2012

(51) Int. Cl.
*F02C 1/00* (2006.01)

(52) U.S. Cl.
USPC ..... 60/737

(58) Field of Classification Search ..... 60/737, 60/740, 742, 746, 747; 239/132.5, 419, 419.3, 239/419.5, 423, 424, 424.5, 427, 427.3, 427.5, 239/428, 430, 433, 556, 557
See application file for complete search history.

(56) References Cited

U.S. PATENT DOCUMENTS 3,943,705 A * 3/1976 DeCorso et al. ..... 60/723
4,100,733 A * 7/1978 Striebel et al. ..... 60/39.463
7,513,115 B2 4/2009 Stuttaford
7,942,038 B2 5/2011 Ziminsky et al.
7,959,880 B2 6/2011 Tonkovich et al.
2010/0146984 A1 6/2010 Carroni et al.
2010/0180564 A1 7/2010 Ziminsky et al.
2010/0218501 A1* 9/2010 York et al. ..... 60/737
2010/0252652 A1* 10/2010 Johnson et al. ..... 239/132
2010/0275601 A1* 11/2010 Berry et al. ..... 60/737
2011/0083439 A1* 4/2011 Zuo et al. ..... 60/737
2012/0058437 A1* 3/2012 Uhm et al. ..... 431/9
2012/0180495 A1* 7/2012 Uhm et al. ..... 60/772
2012/0192566 A1* 8/2012 Uhm et al. ..... 60/740
2012/0198856 A1* 8/2012 Uhm et al. ..... 60/772

* cited by examiner

*Primary Examiner* — Phutthiwat Wongwian
(74) *Attorney, Agent, or Firm* — Armstrong Teasdale LLP

(57) ABSTRACT

A fuel nozzle assembly for use with a turbine engine is described herein. The fuel nozzle assembly includes a plurality of fuel nozzles positioned within an air plenum defined by a casing. Each of the plurality of fuel nozzles is coupled to a combustion liner defining a combustion chamber. Each of the plurality of fuel nozzles includes a housing that includes an inner surface that defines a cooling fluid plenum and a fuel plenum therein, and a plurality of mixing tubes extending through the housing. Each of the mixing tubes includes an inner surface defining a flow channel extending between the air plenum and the combustion chamber. At least one mixing tube of the plurality of mixing tubes including at least one cooling fluid aperture for channeling a flow of cooling fluid from the cooling fluid plenum to the flow channel.

27 Claims, 13 Drawing Sheets

COMBUSTOR ASSEMBLY FOR USE IN A TURBINE ENGINE AND METHODS OF ASSEMBLING SAME

STATEMENT REGARDING FEDERALLY SPONSORED RESEARCH & DEVELOPMENT

This invention was made with Government support under Contract No. DE-FC26-05NT42643, awarded by the Department of Energy. The Government has certain rights in this invention.

BACKGROUND OF THE INVENTION

The subject matter described herein relates generally to turbine engines and more particularly, to combustor assemblies for use in turbine engines.

At least some known gas turbine engines ignite a fuel-air mixture in a combustor assembly to generate a combustion gas stream that is channeled to a turbine via a hot gas path. Compressed air is delivered to the combustor assembly from a compressor. Known combustor assemblies include a combustor liner that defines a combustion region, and a plurality of fuel nozzle assemblies that enable fuel and air delivery to the combustion region. The turbine converts the thermal energy of the combustion gas stream to mechanical energy used to rotate a turbine shaft. The output of the turbine may be used to power a machine, for example, an electric generator or a pump.

At least some known fuel nozzle assemblies include tube assemblies or micro-mixers that enable mixing of substances, such as diluents, gases, and/or air with fuel, to generate a fuel mixture for combustion. Such fuel mixtures may include a hydrogen gas ($H_2$) that is mixed with fuel to create a high hydrogen fuel mixture that is channeled to the combustion region. During combustion of fuel mixtures, at least some known combustors may experience flame holding or flashback in which the combustion flame travels upstream towards the fuel nozzle assembly. Such flame holding/flashback events may result in degradation of emissions performance, overheating, and/or damage to the fuel nozzle assembly.

In addition, during operation of at least some known combustor assemblies, combustion of high hydrogen fuel mixtures may create a plurality of eddies adjacent to an outer surface of the fuel nozzle assembly. Such eddies may increase the temperature within the combustion assembly and/or induce a screech tone frequency that induces vibrations throughout the combustor assembly and fuel nozzle assembly. Over time, continued operation with increased internal temperatures and/or such vibrations may cause wear and/or may shorten the useful life of the combustor assembly.

BRIEF DESCRIPTION OF THE INVENTION

In one aspect, a fuel nozzle assembly for use with a turbine engine is provided. The fuel nozzle assembly includes a plurality of fuel nozzles positioned within an air plenum defined by a casing. Each of the plurality of fuel nozzles is coupled to a combustion liner defining a combustion chamber. Each of the plurality of fuel nozzles includes a housing that includes an inner surface that defines a cooling fluid plenum and a fuel plenum therein, and a plurality of mixing tubes extending through the housing. Each of the mixing tubes includes an inner surface defining a flow channel extending between the air plenum and the combustion chamber. At least one mixing tube of the plurality of mixing tubes includes at least one cooling fluid aperture for channeling a flow of cooling fluid from the cooling fluid plenum to the flow channel. At least one cooling conduit is coupled in flow communication with the cooling fluid plenum for channeling a flow of cooling fluid to the cooling fluid plenum.

In another aspect, a combustor assembly for use with a turbine engine is provided. The combustor assembly includes a casing that includes an air plenum, a combustor liner positioned within the casing and defining a combustion chamber therein, and a fuel nozzle assembly that includes a plurality of fuel nozzles. Each of the plurality of fuel nozzles is coupled to the combustion liner. Each of the plurality of fuel nozzles includes a housing that includes an inner surface that defines a cooling fluid plenum and a fuel plenum therein. A plurality of mixing tubes are coupled in flow communication with the air plenum and extend through the housing. Each of the mixing tubes includes an inner surface that defines a flow channel extending between the air plenum and the combustion chamber. At least one mixing tube of the plurality of mixing tubes includes at least one cooling fluid aperture for channeling a flow of cooling fluid from the cooling fluid plenum to the flow channel. A cooling conduit is coupled in flow communication with the cooling fluid plenum for channeling a flow of cooling fluid to the cooling fluid plenum.

In a further aspect, a method of assembling a fuel nozzle assembly for use with a turbine engine is provided. The method includes coupling a sidewall between a forward endwall and an opposite aft endwall to form a housing having an inner surface that defines a cavity therein. An interior wall is coupled to the housing inner surface such that a fuel plenum is defined between the interior wall and the forward endwall, and such that a cooling fluid plenum is defined between the interior wall and the aft endwall. A plurality of mixing tubes are coupled to the housing, such that each mixing tube of the plurality of mixing tubes extends through the housing, each of the plurality of mixing tubes including an inner surface that defines a flow channel. At least one cooling fluid aperture is defined through the at least one mixing tube to couple the cooling fluid plenum in flow communication with the mixing tube flow channel. A cooling conduit is coupled to the housing such that the cooling conduit is coupled in flow communication with the cooling fluid plenum.

DETAILED DESCRIPTION OF THE INVENTION

The exemplary methods and systems described herein overcome at least some disadvantages of at least some known combustor assemblies by providing a fuel nozzle assembly that includes a mixing tube that is coupled to a cooling fluid plenum that enables cooling fluid to be channeled through and/or around the mixing tube into a combustion chamber to facilitate reducing flame holding/flashback events and reduce $NO_X$ emissions. Moreover, the mixing tube includes a fuel aperture that enables fuel to be channeled into the mixing tube, and a cooling aperture that is downstream of the fuel aperture to enable cooling fluid to be channeled into the mixing tube such that a boundary layer is formed between the fuel mixture and the mixing tube. By channeling cooling fluid into the mixing tube downstream from the fuel mixture, the mixing tube facilitates reducing the probability of flame holding/flashback of the fuel nozzle. In addition, the fuel nozzle assembly includes a plurality of openings that are oriented about the mixing tube to enable cooling fluid to be channeled into the combustion chamber to facilitate reducing the formation of eddies that may induce screech tone frequencies within the fuel nozzle assembly. By reducing the formation of such eddies, undesired vibrations that may cause damage to the fuel nozzle assembly are facilitated to be reduced, such that the operating efficiency and useful life of the turbine engine are increased.

As used herein, the term "cooling fluid" refers to nitrogen, air, fuel, inert gases, or some combination thereof, and/or any other fluid that enables the fuel nozzle to function as described herein. As used herein, the term "upstream" refers to a forward end of a turbine engine, and the term "downstream" refers to an aft end of a turbine engine.

Figure 1:
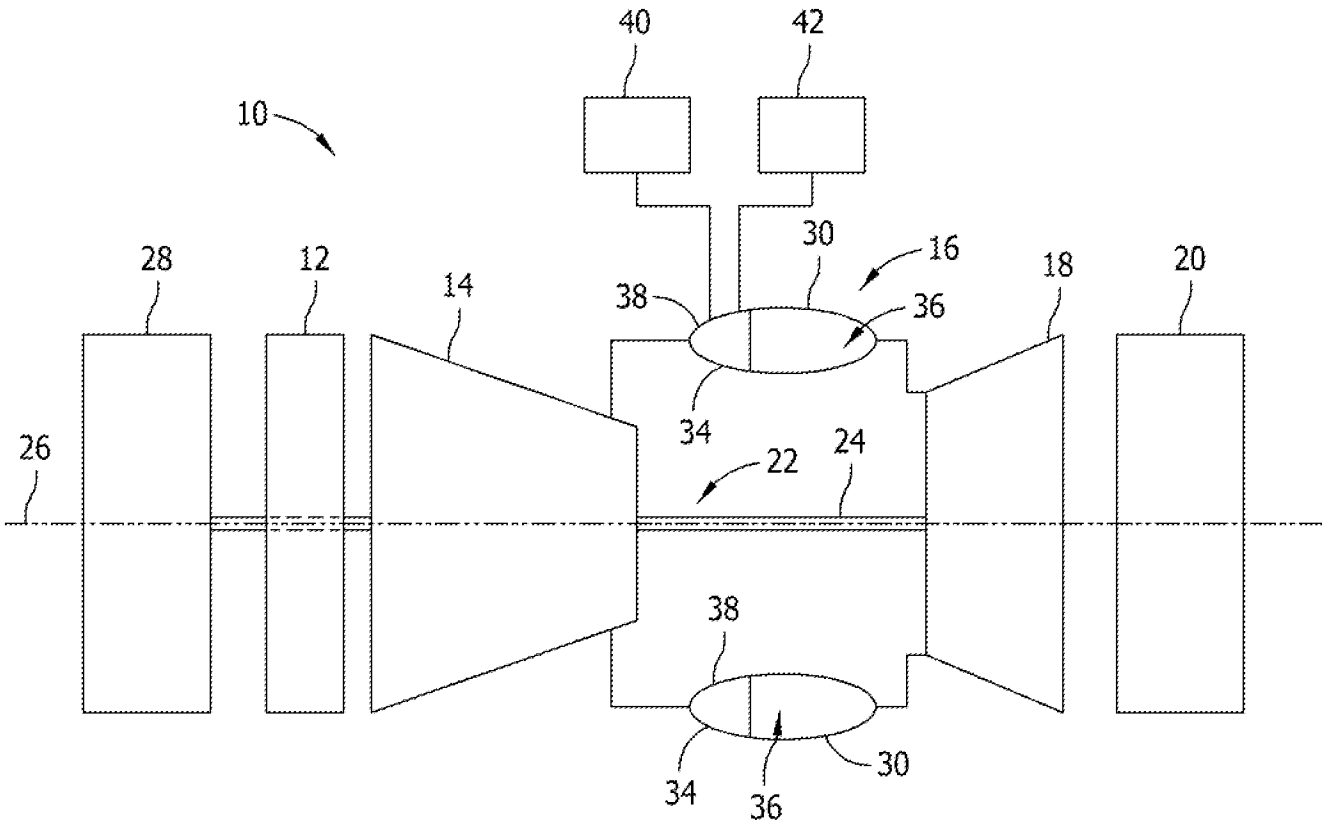
FIG. 1 is a schematic illustration of an exemplary turbine engine.

FIG. 1 is a schematic view of an exemplary turbine engine 10. Turbine engine 10 includes an intake section 12, a compressor section 14 that is downstream from intake section 12, a combustor section 16 downstream from compressor section 14, a turbine section 18 downstream from combustor section 16, and an exhaust section 20 downstream from turbine section 18. Turbine section 18 is coupled to compressor section 14 via a rotor assembly 22 that includes a shaft 24 that extends along a centerline axis 26. Moreover, turbine section 18 is rotatably coupled to compressor section 14 and to a load 28 such as, but not limited to, an electrical generator and/or a mechanical drive application. In the exemplary embodiment, combustor section 16 includes a plurality of combustor assemblies 30 that are each coupled in flow communication with compressor section 14. Each combustor assembly 30 includes a fuel nozzle assembly 34 that is coupled to a combustion chamber 36. In the exemplary embodiment, each fuel nozzle assembly 34 includes a plurality of fuel nozzles 38 that are coupled to combustion chamber 36 for delivering a fuel-air mixture to combustion chamber 36. A fuel supply system 40 is coupled to each fuel nozzle assembly 34 for channeling a flow of fuel to fuel nozzle assembly 34. In addition, a cooling fluid system 42 is coupled to each fuel nozzle assembly 34 for channeling a flow of cooling fluid to each fuel nozzle assembly 34.

During operation, air flows through compressor section 14 and compressed air is discharged into combustor section 16. Combustor assembly 30 injects fuel, for example, natural gas and/or fuel oil, into the air flow, ignites the fuel-air mixture to expand the fuel-air mixture through combustion, and generates high temperature combustion gases. Combustion gases are discharged from combustor assembly 30 towards turbine section 18 wherein thermal energy in the gases is converted to mechanical rotational energy. Combustion gases impart rotational energy to turbine section 18 and to rotor assembly 22, which subsequently provides rotational power to compressor section 14.

Figure 2:
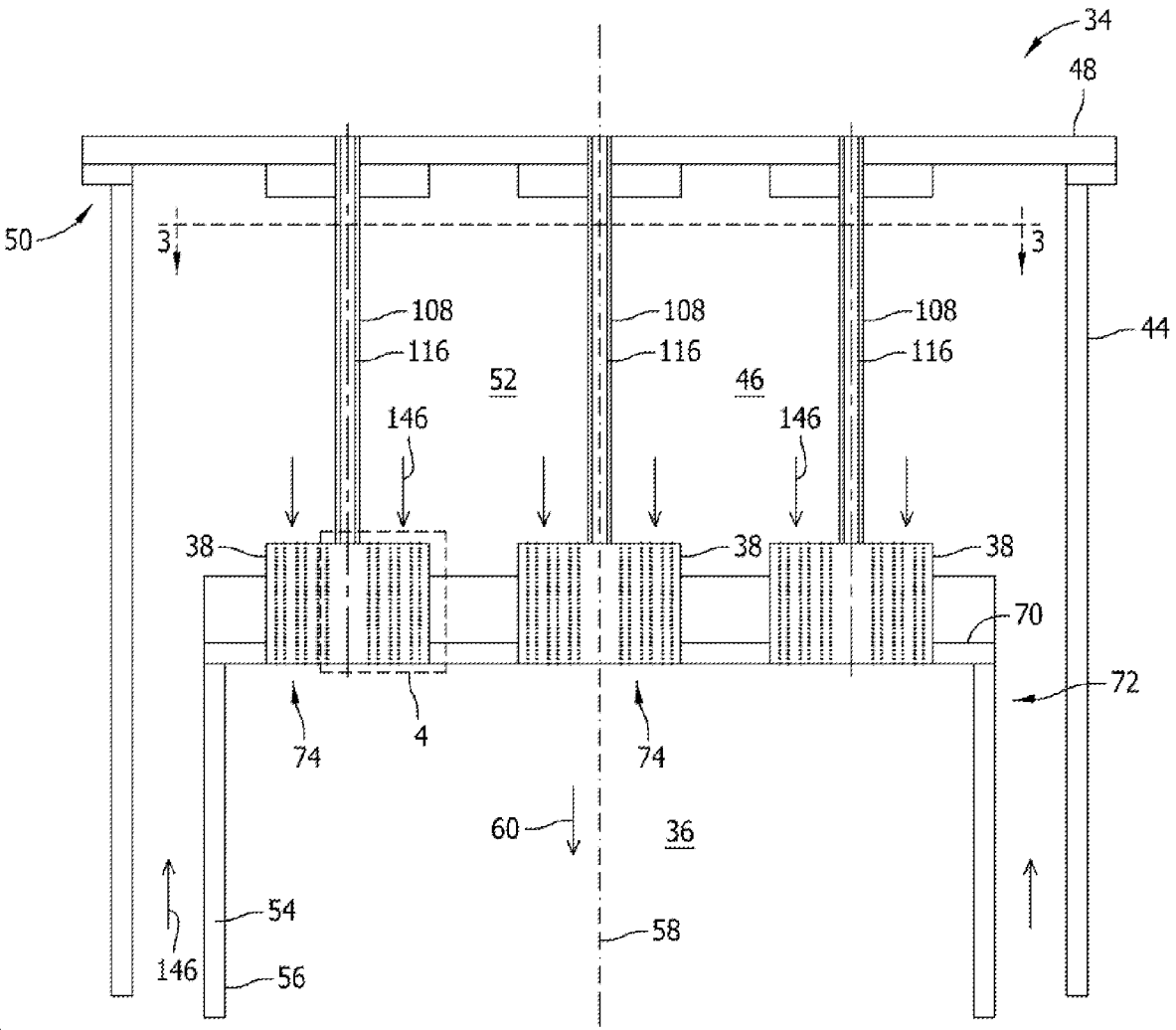
FIG. 2 is a sectional view of an exemplary fuel nozzle assembly that may be used with the turbine engine shown in FIG. 1.
Figure 3:
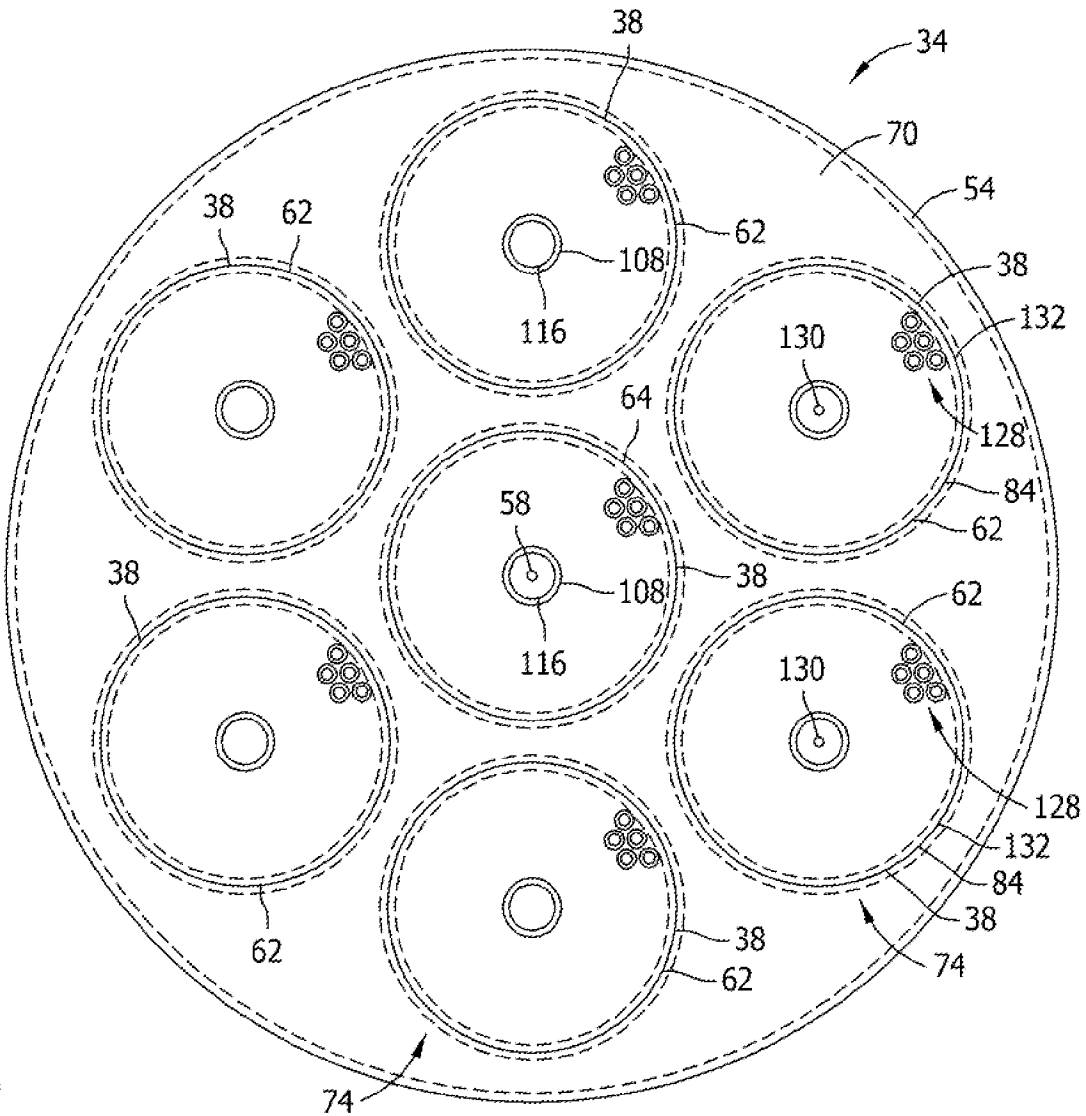
FIG. 3 is a sectional view of a portion of the fuel nozzle assembly with a simplified tube arrangement shown in FIG. 2 and taken along line 3-3.
Figure 4:
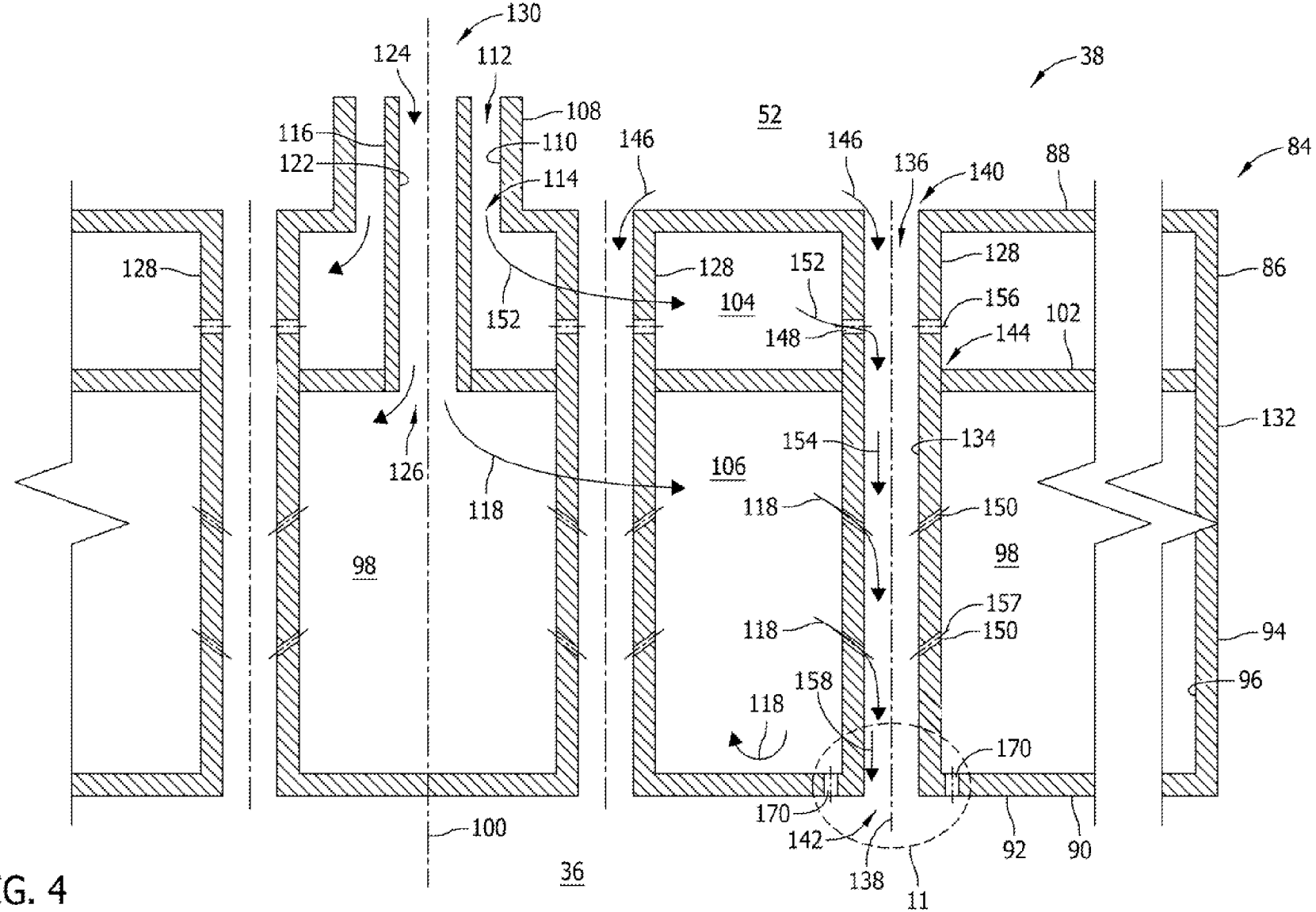
FIG. 4 is an enlarged cross-sectional view of a portion of an exemplary fuel nozzle that may be used with the fuel nozzle assembly shown in FIG. 2 and taken along area 4.

FIG. 2 is a sectional view of an exemplary fuel nozzle assembly 34. FIG. 3 is a sectional view of a portion of fuel nozzle assembly 34 with simplified tube arrangement taken along line 3-3 in FIG. 2. FIG. 4 is an enlarged cross-sectional view of a portion of fuel nozzle 38 taken along area 4 in FIG. 2. In the exemplary embodiment, combustor assembly 30 includes a casing 44 that defines a chamber 46 therein. An end cover 48 is coupled to an outer portion 50 of casing 44 such that an air plenum 52 is defined within chamber 46. Compressor section 14 (shown in FIG. 1) is coupled in flow communication with chamber 46 to channel compressed air downstream from compressor section 14 to air plenum 52.

In the exemplary embodiment, each combustor assembly 30 includes a combustor liner 54 that is positioned within chamber 46 and that is coupled in flow communication with turbine section 18 (shown in FIG. 1) through a transition piece (not shown) and with compressor section 14. Combustor liner 54 includes a substantially cylindrically-shaped inner surface 56 that defines a combustion chamber 36 that extends axially along a centerline axis 58. Combustor liner 54 is coupled to fuel nozzle assembly 34 to enable fuel to be channeled into combustion chamber 36. Combustion chamber 36 defines a combustion gas flow path 60 that extends from fuel nozzle assembly 34 to turbine section 18. In the exemplary embodiment, fuel nozzle assembly 34 receives a flow of air from air plenum 52, receives a flow of fuel from fuel supply system 40, and channels a mixture of fuel/air into combustion chamber 36 to generate combustion gases.

Fuel nozzle assembly 34 includes a plurality of fuel nozzles 38 that are at least partially positioned within air plenum 52 and that are coupled to combustor liner 54. In the exemplary embodiment, fuel nozzle assembly 34 includes a plurality of outer nozzles 62 that are circumferentially-spaced about a center nozzle 64. Center nozzle 64 is oriented along centerline axis 58.

In the exemplary embodiment, an end plate 70 is coupled to an outer portion 72 of combustor liner 54 such that combustion chamber 36 is defined between end plate 70 and combustor liner 54. End plate 70 includes a plurality of openings 74 that extends through end plate 70 and that are each sized and shaped to receive a fuel nozzle 38 therethrough. Each fuel nozzle 38 is positioned within a corresponding opening 74 such that nozzle 38 is coupled in flow communication with combustion chamber 36. In an alternative embodiment, fuel nozzle assembly 34 does not include end plate 70, and fuel nozzle 34 is coupled to an adjacent fuel nozzle 34.

In the exemplary embodiment, each fuel nozzle 38 includes a housing 84 that includes a sidewall 86 that extends between a forward endwall 88 and an opposite aft endwall 90. Aft endwall 90 is between forward endwall 88 and combustion chamber 36, and includes an outer surface 92 that at least partially defines combustion chamber 36. Sidewall 86 includes a radially outer surface 94 and a radially inner surface 96. Radially inner surface 96 defines a substantially cylindrical cavity 98 that extends between forward endwall 88 and aft endwall 90, along a longitudinal axis 100.

An interior wall 102 is positioned within cavity 98 and extends inward from inner surface 96 such that a fuel plenum 104 is defined between interior wall 102 and forward endwall 88, and such that a cooling fluid plenum 106 is defined between interior wall 102 and aft endwall 90. In the exemplary embodiment, interior wall 102 is oriented such that cooling fluid plenum 106 is downstream from fuel plenum 104 along longitudinal axis 100. Alternatively, interior wall 102 may be oriented such that cooling fluid plenum 106 is upstream of fuel plenum 104.

In the exemplary embodiment, a fuel conduit 108 is coupled in flow communication with fuel plenum 104 for channeling fuel from fuel supply system 40 to fuel plenum 104. Fuel conduit 108 extends between end cover 48 and housing 84 and includes an inner surface 110 that defines a fuel channel 112 that is coupled to fuel plenum 104. Moreover, fuel conduit 108 is coupled to forward endwall 88 and is oriented with respect to an opening 114 that extends through forward endwall 88 to couple fuel channel 112 to fuel plenum 104.

A plurality of cooling conduits 116 extends between cooling fluid system 42 (shown in FIG. 1) and fuel nozzle assembly 34 for channeling cooling fluid to fuel nozzle assembly 34. In the exemplary embodiment, each cooling conduit 116 is coupled to a corresponding fuel nozzle 38 for channeling a flow of cooling fluid 118 to cooling fluid plenum 106. Moreover, each cooling conduit 116 includes an inner surface 122 that defines a cooling channel 124, and each is coupled to interior wall 102 such that cooling channel 124 is in flow communication with cooling fluid plenum 106. In the exemplary embodiment, cooling conduit 116 is within fuel conduit 108 and extends through fuel plenum 104 to interior wall 102. Cooling conduit 116 is oriented with respect to an opening 126 extending through interior wall 102 such that cooling channel 124 is coupled in flow communication with cooling fluid plenum 106. Moreover, cooling conduit 116 is configured to inject cooling fluid 118 into mixing tubes 128 to facilitate improving flame holding/flashback margin and $NO_x$ performance. In addition, cooling conduit 116 channels at least a portion of cooling fluid 118 towards aft endwall 90, and discharges cooling fluid 118 around an outlet of mixing tubes 128 to facilitate convective cooling of aft endwall 90.

In the exemplary embodiment, fuel nozzle 38 includes a plurality of mixing tubes 128 that each extend through housing 84. Mixing tubes 128 are oriented in a plurality of rows that extend outwardly from a center portion 130 of fuel nozzle assembly 34 towards an outer surface 132 of housing 84, and are spaced circumferentially about nozzle center portion 130. Each mixing tube 128 includes a substantially cylindrical inner surface 134 that defines a flow channel 136 that extends between forward endwall 88 and aft endwall 90 and along a centerline axis 138. More specifically, inner surface 134 extends between an inlet opening 140 extending through forward endwall 88, and an outlet opening 142 extending through aft endwall 90, to couple air plenum 52 to combustion chamber 36. In addition, each mixing tube 128 extends through a plurality of openings 144 defined in interior wall 102. Flow channel 136 is sized and shaped to enable air 146 to be channeled from air plenum 52 into combustion chamber 36. In the exemplary embodiment, each mixing tube 128 is substantially parallel to longitudinal axis 100. Alternatively, at least one mixing tube 128 may be oriented obliquely with respect to longitudinal axis 100.

In the exemplary embodiment, at least one mixing tube 128 includes at least one fuel aperture 148, and at least one cooling fluid aperture 150 defined therein. Fuel aperture 148 extends through mixing tube inner surface 134 to couple fuel plenum 104 to flow channel 136. Fuel aperture 148 is configured to enable fuel 152 to be channeled from fuel plenum 104 to flow channel 136 to facilitate mixing fuel 152 with air 146 to form a fuel-air mixture 154 that is channeled to combustion chamber 36. In the exemplary embodiment, fuel aperture 148 extends along a centerline axis 156 that is oriented substantially perpendicular to flow channel axis 138. Alternatively, fuel aperture 148 may be oriented obliquely with respect to flow channel axis 138.

Cooling fluid aperture 150 extends through mixing tube inner surface 134 to couple cooling fluid plenum 106 to flow channel 136. In the exemplary embodiment, cooling fluid aperture 150 extends along a centerline axis 157 that is oriented obliquely with respect to flow channel axis 138. Cooling fluid aperture 150 is sized and shaped to discharge cooling fluid 118 into flow channel 136 to facilitate forming a boundary layer 158 between mixing tube inner surface 134 and fuel-air mixture 154, and to facilitate reducing flame holding/flashback events within mixing tube 128. In the exemplary embodiment, cooling fluid aperture 150 is oriented with respect to flow channel axis 158 such that cooling fluid 118 is discharged obliquely towards outlet opening 142. Alternatively, cooling fluid aperture 150 may be oriented substantially perpendicularly with respect to flow channel axis 158. In another embodiment, cooling fluid aperture 150 may be oriented to discharge cooling fluid 118 towards inlet opening 140.

Figure 5:
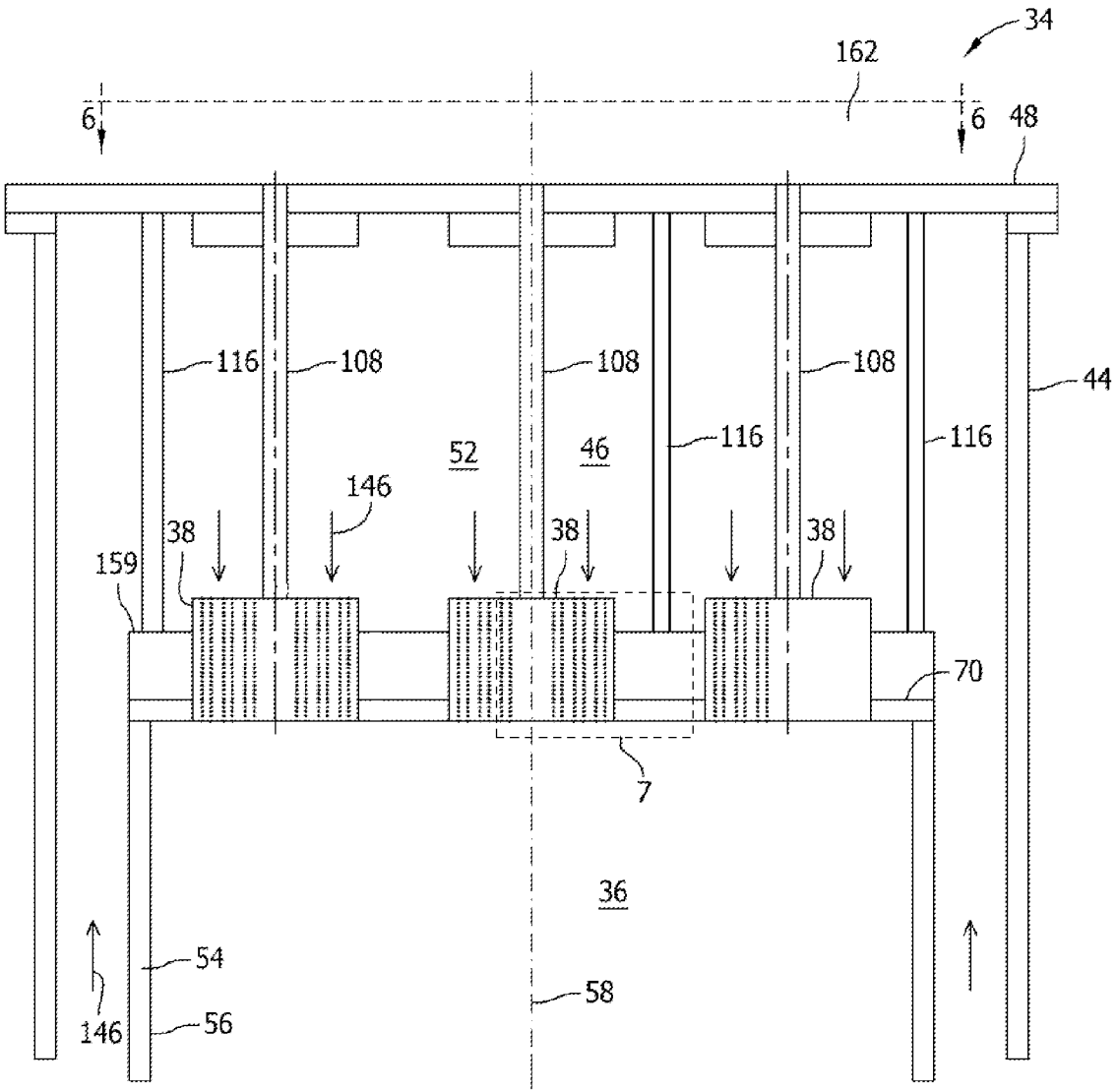
FIG. 5 is a sectional view of an alternative embodiment of the fuel nozzle assembly shown in FIG. 2.
Figure 6:
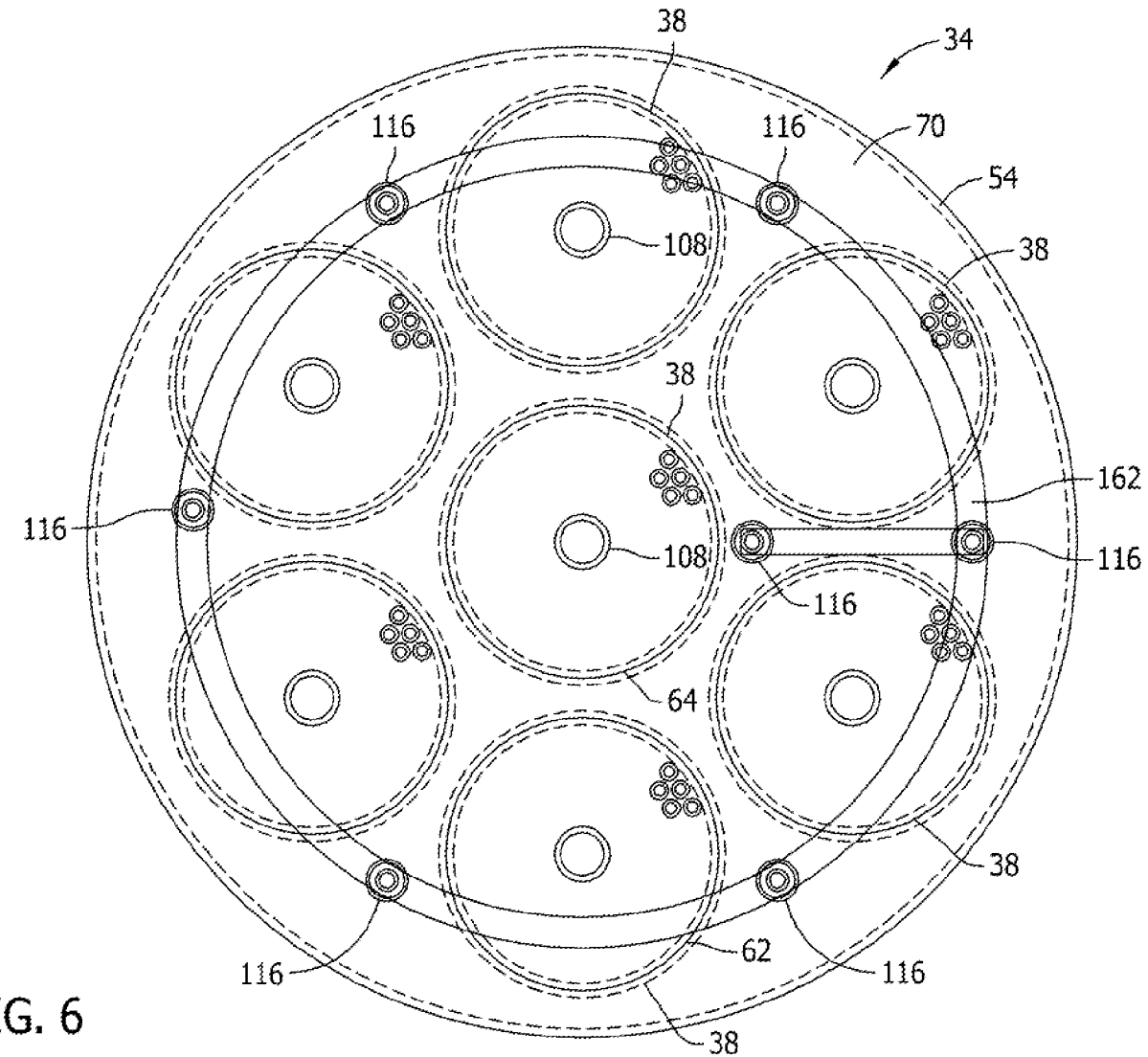
FIG. 6 is a sectional view of a portion of the fuel nozzle assembly shown in FIG. 5 and taken along line 6-6.
Figure 7:
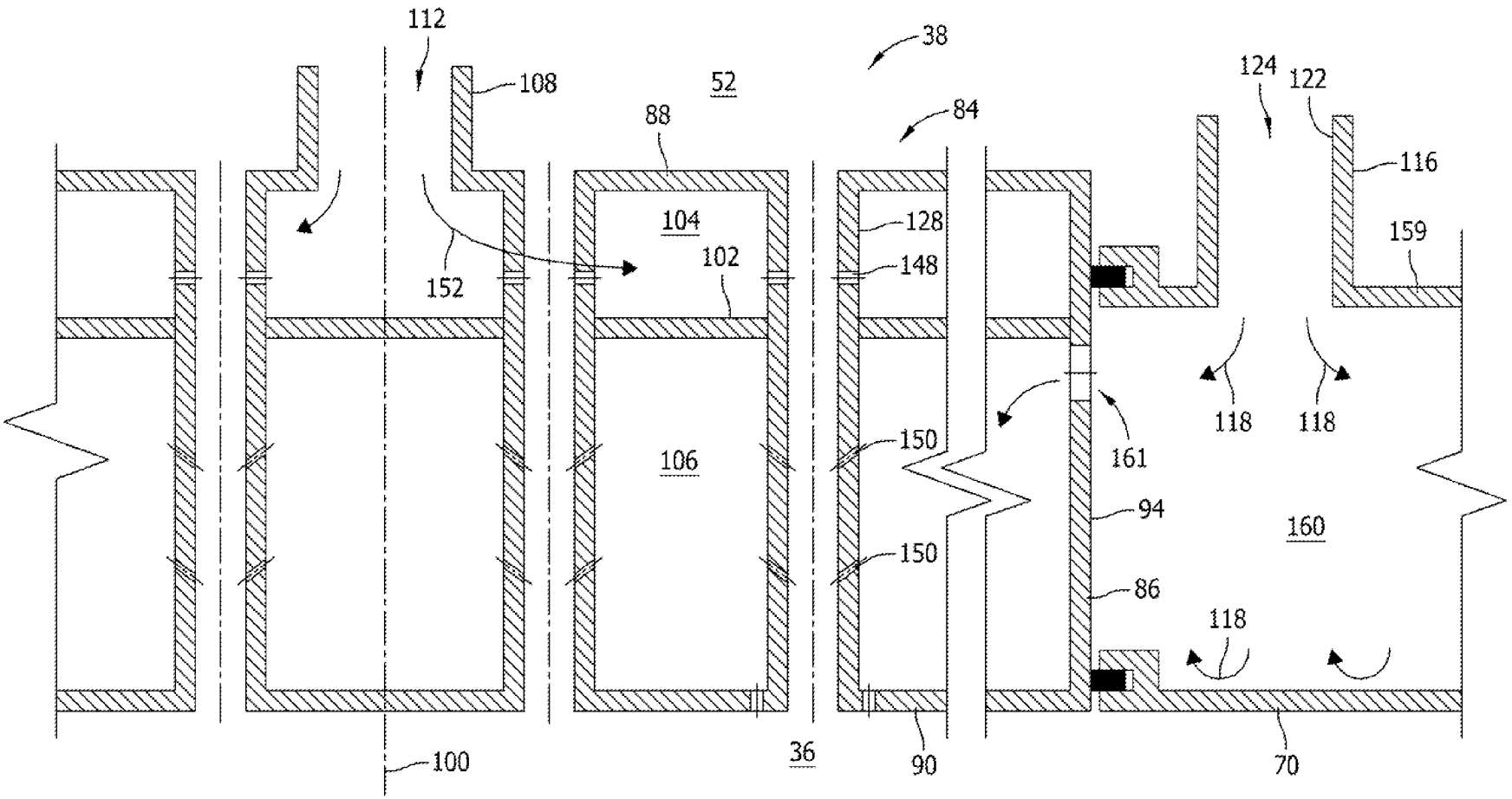
FIG. 7 is an enlarged cross-sectional view of a portion of an alternative embodiment of the fuel nozzle shown in FIG. 5 and taken along area 7.

FIG. 5 is a sectional view of an alternative embodiment of fuel nozzle assembly 34. FIG. 6 is a sectional view of a portion of fuel nozzle assembly 34 and taken along line 6-6. FIG. 7 is an enlarged cross-sectional view of a portion of fuel nozzle 38 and taken along area 7 shown in FIG. 5. Identical components shown in FIGS. 5-7 are labeled with the same reference numbers used in FIGS. 2-4. In an alternative embodiment, an impingement plate 159 is coupled to end plate 70 and is spaced a distance outwardly from end plate 70 such that a chamber 160 is defined between end plate 70 and impingement plate 159. Sidewall outer surface 94 is coupled to end plate 70 and impingement plate 159 such that chamber 160 is defined between outer surface 94, impingement plate 159, and end plate 70. Sidewall 86 includes at least one opening 161 that extends through sidewall outer surface 94 to coupled cooling fluid plenum 106 with chamber 160. Cooling conduit 116 is coupled to sidewall outer surface 94 and oriented with respect to opening 161 to couple cooling channel 124 in flow communication with cooling fluid plenum 106. More specifically, cooling conduit 116 is coupled to impingement plate 159 such that cooling channel 124 is in flow communication with chamber 160. Opening 161 is sized and shaped to enable cooling fluid to be channeled from cooling channel 124 to cooling fluid plenum 106. In addition, cooling conduit 116 is oriented to channel cooling fluid 118 towards end plate 70 to facilitate convective cooling of end plate 70.

In addition, each cooling conduit 116 is coupled to a cooling manifold 162 that includes a plurality of valves (not shown) that correspond to each cooling conduit 116 to enable cooling fluid to be selectively channeled to each cooling conduit 116.

Figure 8:
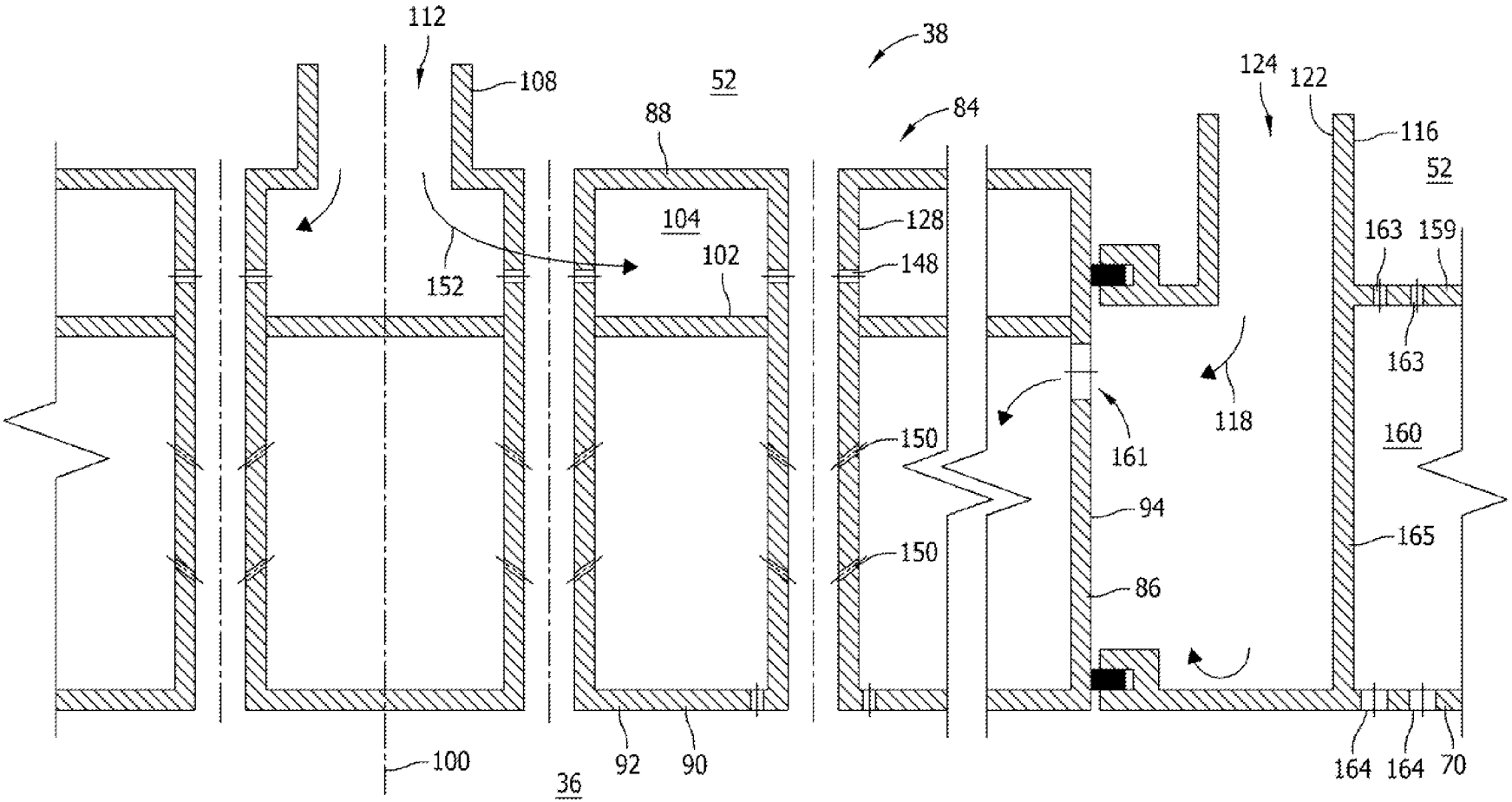
FIGS. 8-10 are enlarged cross-sectional views of alternative embodiments of the fuel nozzle that may be used with the fuel nozzle assembly shown in FIG. 5.
Figure 9:
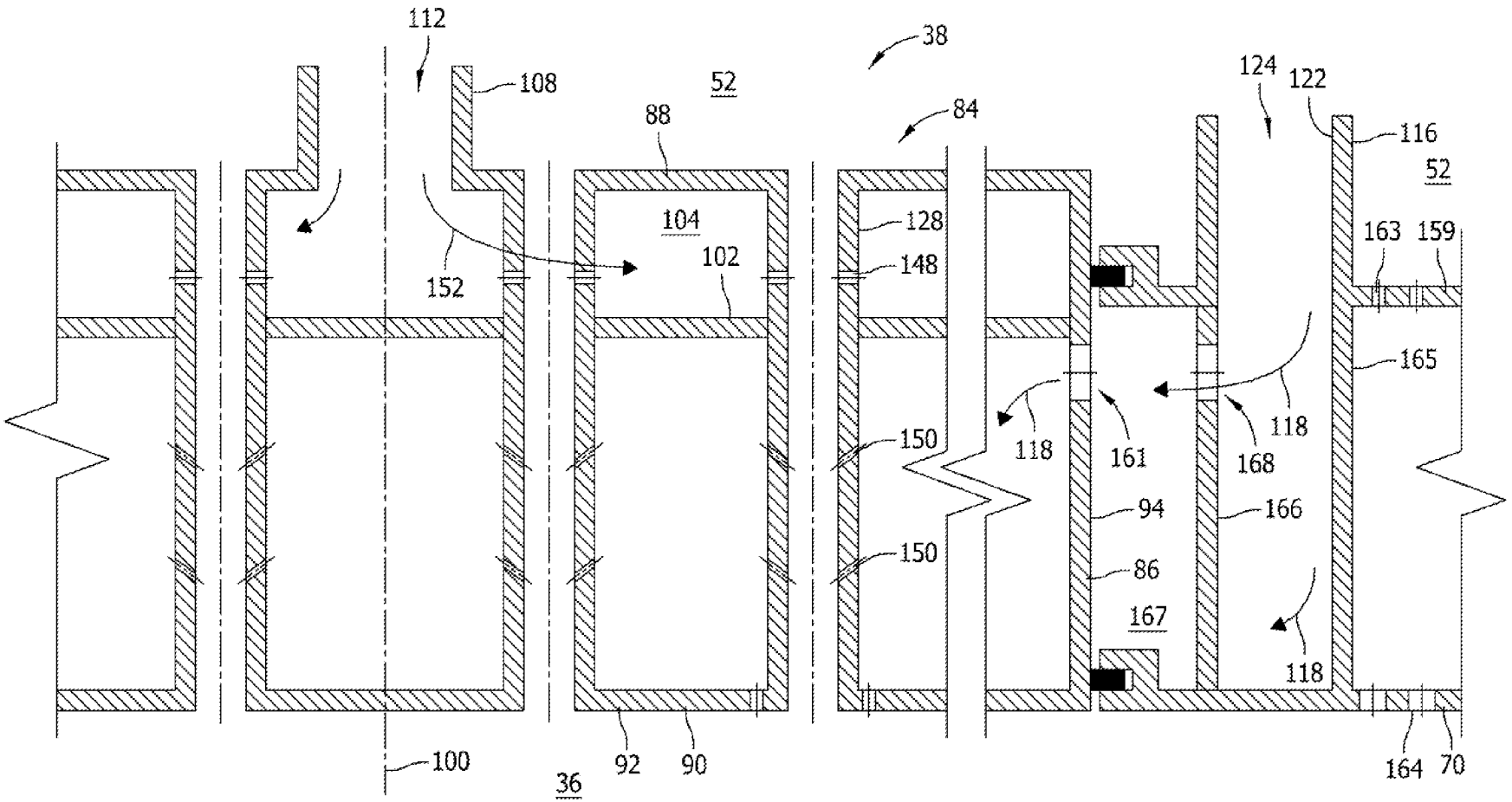
Figure 10:
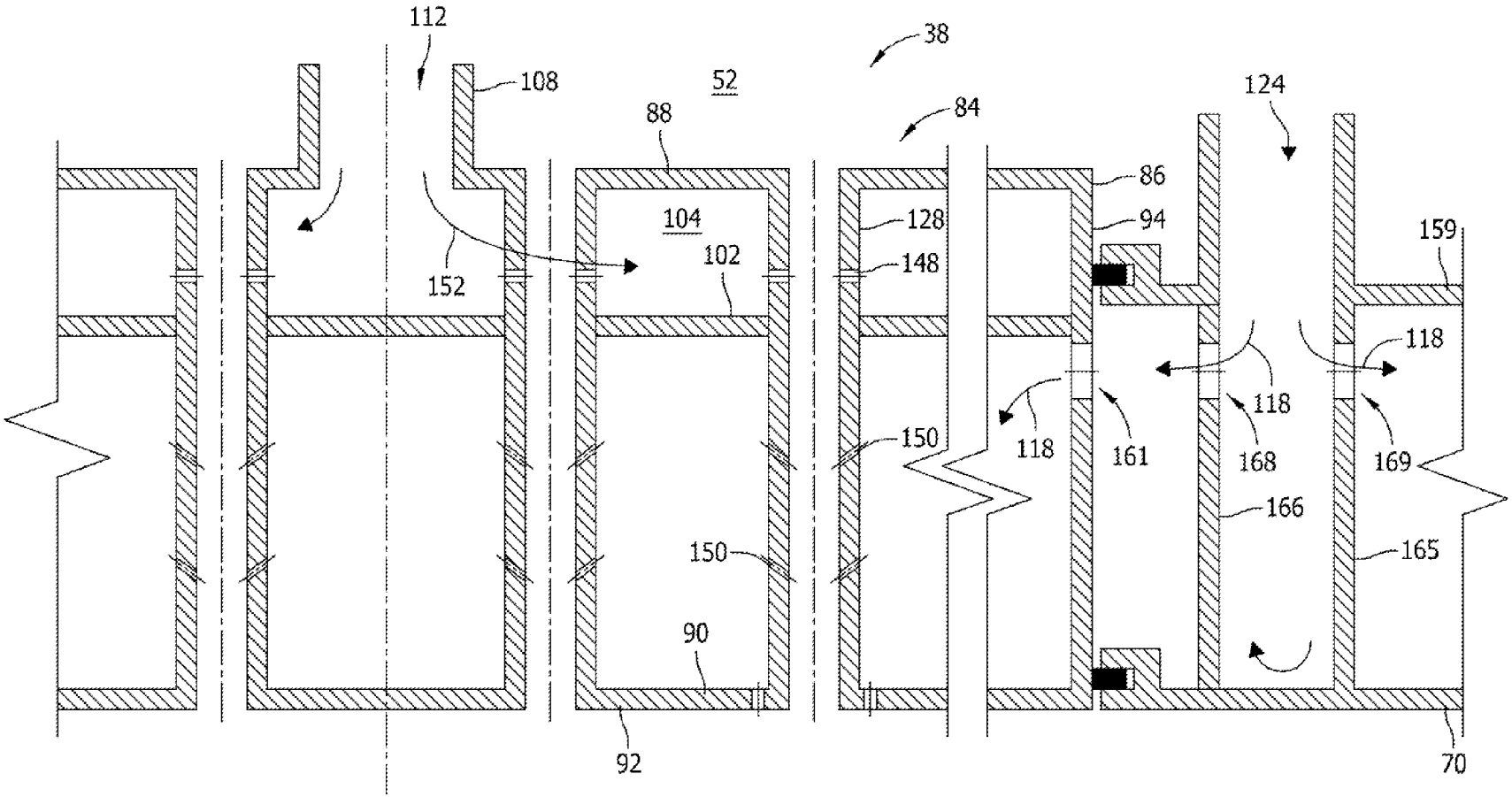

FIGS. 8-10 are enlarged cross-sectional views of alternative embodiments of fuel nozzle 38. Identical components shown in FIGS. 8-10 are labeled with the same reference numbers used in FIG. 7. Referring to FIG. 8, in another embodiment, impingement plate 159 includes a plurality of impingement openings 163 that are each sized and shaped to enable air from air plenum 52 to be channeled into chamber 160 to facilitate impingement cooling of end plate 70. In addition, end plate 70 includes a plurality of effusion openings 164 that extend through end plate 70 and are each sized and shaped to enable air to be channeled from chamber 160 into combustion chamber 36 to facilitate cooling of end plate 70. A separation wall 165 extends between cooling conduit 116 and end plate 70 to isolate cooling channel 124 from chamber 160. Separation wall 165 is sized and shaped to channel cooling fluid 118 from cooling channel 124 to cooling fluid plenum 106 through opening 161.

Referring to FIGS. 9 and 10, in an alternative embodiment, a divider wall 166 is coupled to cooling conduit 116 such that divider wall 166 at least partially defines cooling channel 124. Divider wall 166 is positioned between cooling conduit 116 and housing 84 such that a chamber 167 is defined between divider wall 166 and sidewall outer surface 94. Divider wall 166 includes at least one opening 168 that extends through divider wall 166 to couple cooling channel 124 in flow communication with chamber 167 such that cooling fluid 118 is channeled from cooling channel 124, through chamber 167, and to cooling fluid plenum 106. In addition, in one embodiment, separation wall 165 includes at least one opening 169 to coupled cooling channel 124 in flow communication with chamber 160. In such an embodiment, impingement plate 159 and end plate 70 may not include openings 163 and 164, respectively.

Figure 11:
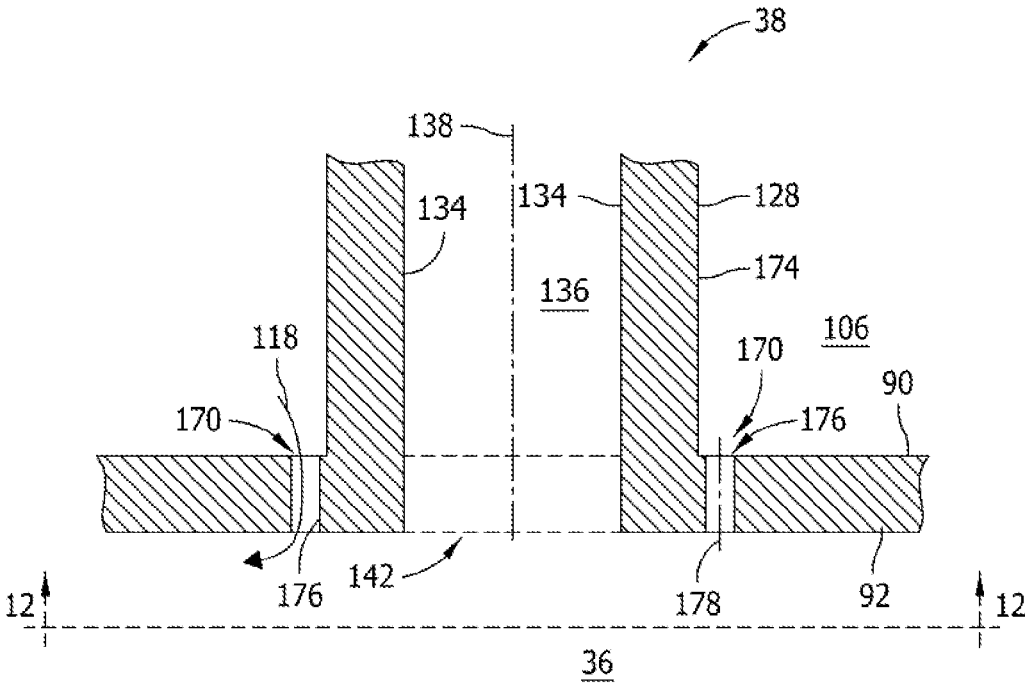
FIG. 11 is an enlarged sectional view of a portion of the fuel nozzle shown in FIG. 4 and taken along area 11.
Figure 12:
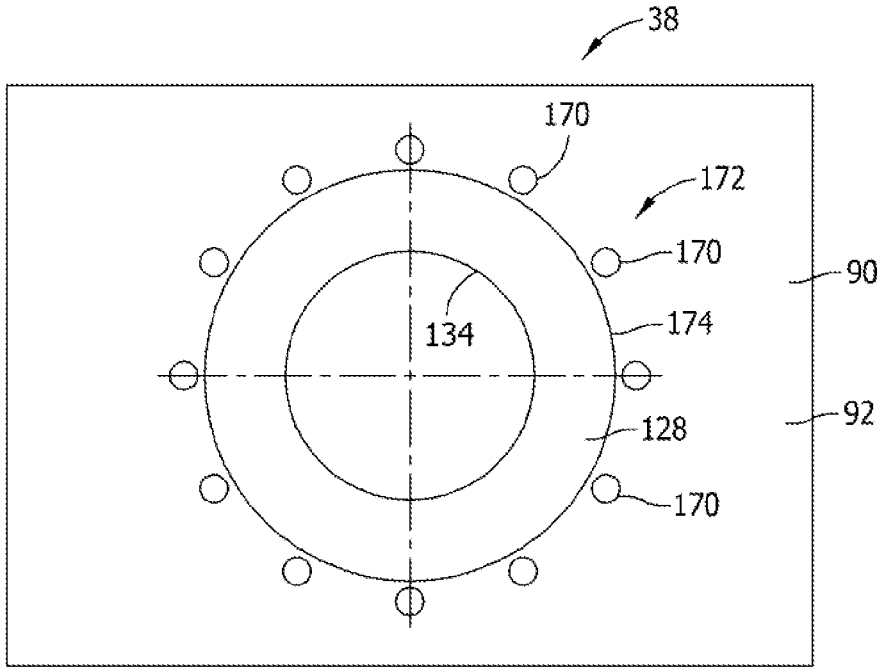
FIG. 12 is a sectional view of a portion of the fuel nozzle shown FIG. 11 and taken along line 12-12.

FIG. 11 is an enlarged sectional view of a portion of fuel nozzle 38 and taken along area 11 shown in FIG. 4. FIG. 12 is a sectional view of a portion of fuel nozzle 38 taken along line 12-12 and shown FIG. 11. Identical components shown in FIGS. 11 and 12 are labeled with the same reference numbers used in FIGS. 2-4. In the exemplary embodiment, aft endwall 90 includes a plurality of cooling openings 170 that extend through aft endwall 90 to enable cooling fluid 118 to be channeled from cooling fluid plenum 106 into combustion chamber 36. Cooling openings 170 are spaced circumferentially about mixing tube 128. More specifically, fuel nozzle assembly 34 includes at least one set 172 of cooling openings 170 that are spaced circumferentially about an outer surface 174 of at least one mixing tube 128. In one embodiment, fuel nozzle assembly 34 includes a plurality of sets 172 of cooling opening 170 that are each oriented with respect to a corresponding mixing tube 128. Each cooling opening 170 is sized and shaped to discharge cooling fluid 118 towards combustion chamber 36 to enable combustion flow dynamics downstream of endwall outer surface 92 to be adjusted such that secondary mixing of fuel and air through opening 170 and outlet opening 142 occurs to facilitate improving fuel and air mixing, and to facilitate reducing an amplitude of screech tone frequency noise generated during operation of combustor assembly 30.

In the exemplary embodiment, each cooling opening 170 includes an inner surface 176 that extends along a centerline axis 178 that is oriented substantially parallel to mixing tube axis 138. Alternatively, each cooling opening 170 may be oriented obliquely with respect to mixing tube axis 138. In one embodiment, each cooling opening 170 is oriented such that cooling fluid 118 is discharged towards mixing tube flow channel 136. In another embodiment, each cooling opening 170 is oriented such that cooling fluid 118 is discharged away from mixing tube 128.

Figure 13:
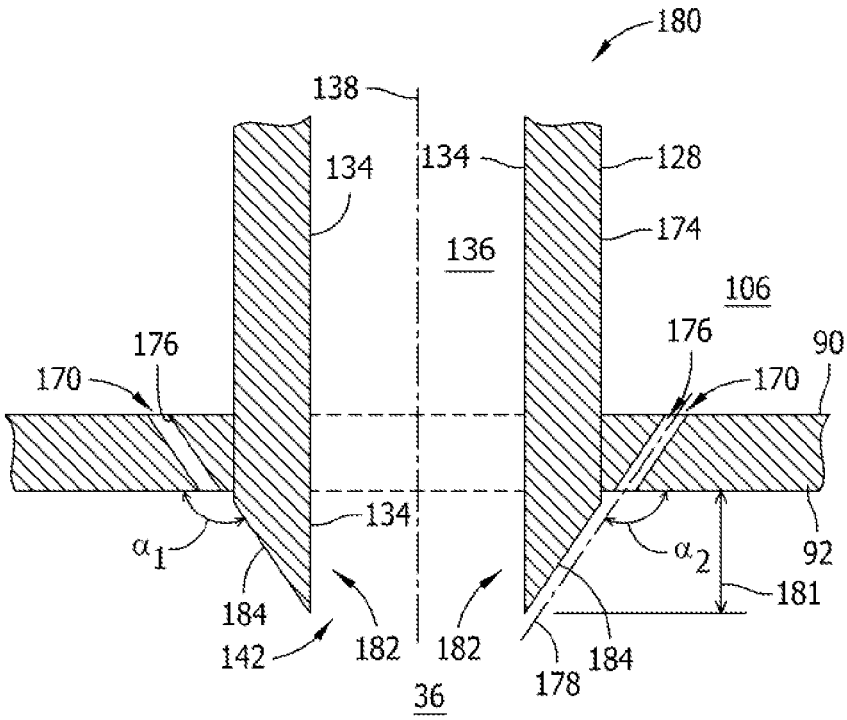
FIGS. 13-15 are enlarged sectional views of alternative embodiments of the fuel nozzle shown in FIG. 11.
Figure 14:
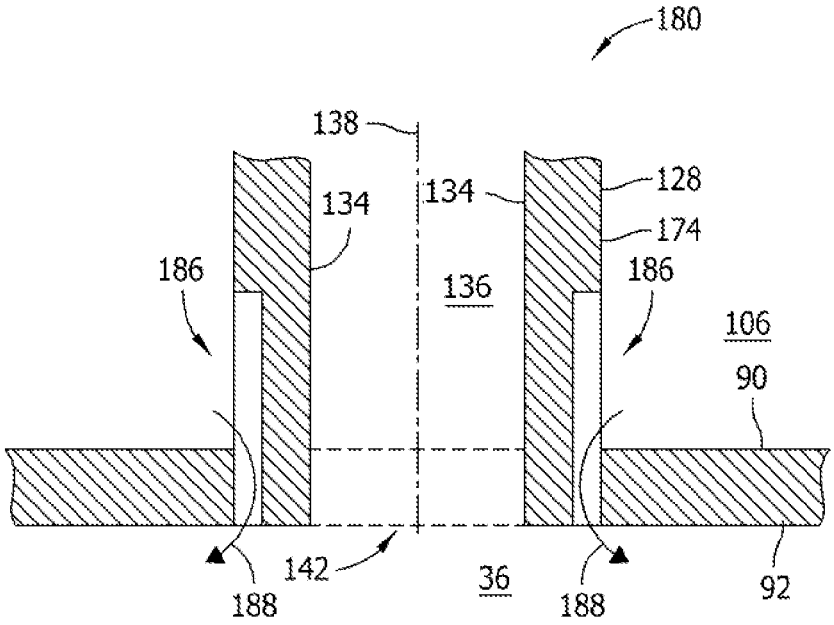
Figure 15:
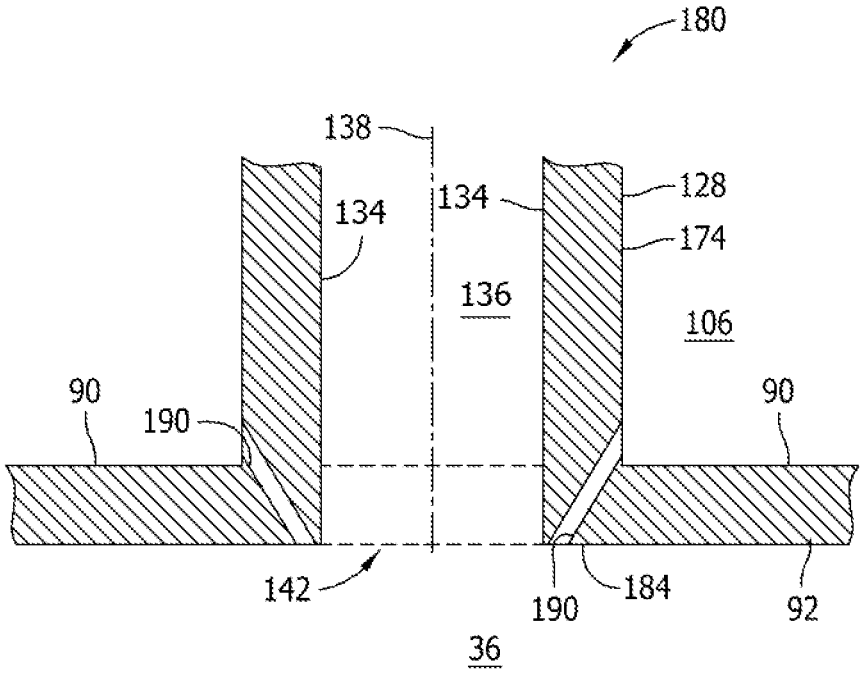

FIGS. 13-15 are enlarged sectional views of an alternative fuel nozzle 180. Identical components shown in FIGS. 13-15 are labeled with the same reference numbers used in FIG. 11. Referring to FIG. 13, in an alternative embodiment, mixing tube 128 includes an inner surface 134 that extends a distance 181 outwardly from aft endwall outer surface 92, and towards combustion chamber 36. Mixing tube 128 also includes a tip end 182 that includes a tip surface 184 that extends between inner surface 134 and outer surface 174. In the exemplary embodiment, tip surface 184 is oriented at a first oblique angle $\alpha_l$ with respect to aft endwall outer surface 92. Each cooling opening 170 is oriented at a second oblique angle $\alpha_2$ that is approximately equal to first oblique angle $\alpha_1$ such that each cooling channel discharges cooling fluid along tip surface 184, and towards flow channel 136.

Referring to FIG. 14, in another embodiment, mixing tube 128 includes at least one slot 186 that is defined along mixing tube outer surface 174 to couple cooling fluid plenum 106 in flow communication with combustion chamber 36. Slot 186 is sized and shaped to discharge cooling fluid 118 from cooling fluid plenum 106 to combustion chamber 36 to facilitate forming a jet layer 188 around mixing tube outer surface 174, and across aft endwall 90 to adjust combustion flow dynamics downstream of endwall outer surface 92 such that secondary mixing of fuel and air through slot 186 and outlet opening 142 occurs to facilitate improving fuel and air mixing, and to reduce an amplitude of screech tone frequency noise generated during operation of combustor assembly 30. In one embodiment, slot 186 is oriented substantially parallel to flow channel 136. Alternatively, slot 186 may be oriented obliquely with respect to flow channel 136 such that slot 186 extends from outer surface 174 towards inner surface 134. In addition, in one embodiment, mixing tube 128 includes a plurality of slots 186 oriented circumferentially about outer surface 174. In another embodiment, mixing tube 128 extends outwardly from endwall outer surface 92 as shown in FIG. 13.

Referring to FIG. 15, in one embodiment, mixing tube 128 includes at least one channel 190 extending from outer surface 174 towards mixing tube inner surface 122. Channel 190 extends through tip surface 184 to couple cooling fluid plenum 106 in flow communication with combustion chamber 36. Channel 190 is sized and shaped to enable cooling fluid to be channeled from cooling fluid 118 from cooling fluid plenum 106 to combustion chamber 36 to facilitate secondary mixing of fuel and air through channel 190 and outlet opening 142.

The size, shape, and orientation of cooling fluid aperture 150 are selected to facilitate channeling cooling fluid into mixing tube 128 to facilitate reducing a flame holding/flashback event and to facilitate mixing fuel/air mixture with cooling fluid. In addition, the size, shape, and orientation of cooling openings 170, slot 186, and channel 190 are selected to facilitate forming a jet layer across aft endwall 90 and within combustion chamber 36 to adjust combustion flow dynamics and to facilitate reducing the amplitude of screech tone frequencies that cause undesired vibrations within fuel nozzle assembly 34.

The above-described apparatus and methods overcome at least some disadvantages of known combustor assemblies by providing a fuel nozzle assembly that includes a mixing tube that is coupled to a cooling fluid plenum such that cooling fluid may be channeled into the mixing tube to facilitate forming a boundary layer between a fuel/air mixture and the mixing tube to reduce undesirable flame holding/flashback events. Moreover, the mixing tube includes a fuel aperture that enables fuel to be channeled into the mixing tube, and a cooling aperture that is downstream of the fuel aperture to enable cooling fluid to be channeled into the mixing tube such that a boundary layer is formed between the fuel mixture and the mixing tube. By channeling cooling fluid into the mixing tube downstream from the fuel mixture, the mixing tube facilitates reducing the operating temperature of the fuel nozzle. In addition, the fuel nozzle assembly includes a plurality of openings that are oriented about the mixing tube to enable cooling fluid to be channeled into the combustion chamber to generate secondary mixing of the fuel/air mixture with cooling fluid to reduce NOx formation, and to facilitate reducing the formation of eddies that may induce screech tone frequencies within the fuel nozzle assembly. By reducing the formation of such eddies, undesired vibrations that may cause damage to the fuel nozzle assembly are facilitated to be reduced, such that the operating efficiency and useful life of the turbine engine are increased.

Exemplary embodiments of a combustor assembly for use in a turbine engine and methods for assembling the same are described above in detail. The methods and apparatus are not limited to the specific embodiments described herein, but rather, components of systems and/or steps of the method may be utilized independently and separately from other components and/or steps described herein. For example, the methods and apparatus may also be used in combination with other combustion systems and methods, and are not limited to practice with only the turbine engine assembly as described herein. Rather, the exemplary embodiment can be implemented and utilized in connection with many other combustion system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel nozzle assembly for use with a turbine engine, said fuel nozzle assembly comprising:

a plurality of fuel nozzles positioned within an air plenum defined by a casing, each of said plurality of fuel nozzles coupled to a combustion liner defining a combustion chamber, each of said plurality of fuel nozzles comprises:

a housing comprising a sidewall extending between a forward endwall and an opposite aft endwall, said sidewall comprising an inner surface that defines a cooling fluid plenum and a fuel plenum therein, said sidewall comprising at least one opening extending through said inner surface of said sidewall; and a plurality of mixing tubes extending through said housing, wherein each of said mixing tubes comprises an inner surface defining a flow channel extending between the air plenum and the combustion chamber, at least one mixing tube of said plurality of mixing tubes comprises at least one cooling fluid aperture for channeling a flow of cooling fluid from said cooling fluid plenum to said flow channel; and at least one cooling conduit coupled to said sidewall such that said at least one sidewall opening couples said cooling conduit in flow communication with said cooling fluid plenum for channeling a flow of cooling fluid to said cooling fluid plenum.

2. A fuel nozzle assembly in accordance with claim 1, wherein said at least one mixing tube comprises at least one fuel aperture for channeling a flow of fuel from said fuel plenum to said flow channel.

3. A fuel nozzle assembly in accordance with claim 1, wherein said housing further comprises:

an interior wall extending inwardly from said sidewall inner surface such that said fuel plenum is defined between said interior wall and said forward endwall, and such that said cooling fluid plenum is defined between said interior wall and said aft endwall.

4. A fuel nozzle assembly in accordance with claim 3, wherein said interior wall comprises an opening extending through said interior wall, said cooling conduit coupled to said interior wall such that said interior wall opening couples said cooling conduit in flow communication with said cooling fluid plenum.

5. A fuel nozzle assembly in accordance with claim 1, further comprising:

an end plate coupled to an outer surface of said sidewall; and an impingement plate coupled to said sidewall outer surface and spaced outwardly from said end plate such that a first chamber is defined between said endplate and said impingement plate, said cooling conduit coupled to said impingement plate to channel a flow of cooling fluid to said first chamber and to said cooling fluid plenum.

6. A fuel nozzle assembly in accordance with claim 5, further comprising a separation wall coupled between said cooling conduit and said end plate to isolate said cooling conduit from said first chamber.

7. A fuel nozzle assembly in accordance with claim 6, wherein said separation wall comprises at least one opening extending through said separation wall to couple said cooling conduit in flow communication with said plurality of fuel nozzles.

8. A fuel nozzle assembly in accordance with claim 6, further comprising a divider wall coupled between said cooling conduit and said housing sidewall such that a second chamber is defined between said sidewall and said divider wall, said divider wall comprising at least one opening extending through said divider wall to couple said cooling conduit in flow communication with said cooling fluid plenum through said chamber.

9. A fuel nozzle assembly in accordance with claim 3, further comprising a plurality of openings extending through said aft endwall to couple said cooling fluid plenum to said combustion chamber, said plurality of openings oriented circumferentially about said at least one mixing tube.

10. A fuel nozzle assembly in accordance with claim 9, wherein said at least one mixing tube comprising a tip end that extends outwardly from said aft endwall towards said combustion chamber.

11. A fuel nozzle assembly in accordance with claim 10, wherein each of said plurality of openings is oriented at a first oblique angle with respect to said aft endwall, said mixing tube tip end comprises a tip surface that is oriented at a second oblique angle that is approximately equal to said first oblique angle.

12. A fuel nozzle assembly in accordance with claim 1, wherein said at least one mixing tube comprises an outer surface and at least one slot defined along said outer surface to couple said cooling fluid plenum in flow communication with said combustion chamber.

13. A fuel nozzle assembly in accordance with claim 1, wherein said at least one mixing tube comprises a tip end extending between an inner surface and an outer surface of said at least one mixing tube, and at least one channel extending from said outer surface towards said tip end to channel cooling fluid from said cooling fluid plenum towards the combustion chamber.

14. A combustor assembly for use with a turbine engine, said combustor assembly comprising:

a casing comprising an air plenum;

a combustor liner positioned within said casing and defining a combustion chamber therein; and a fuel nozzle assembly comprising a plurality of fuel nozzles, each of said plurality of fuel nozzles coupled to said combustion liner, each of said plurality of fuel nozzles comprises:

a housing comprising a forward endwall, and aft endwall, and a sidewall extending between said forward endwall and said aft endwall, said sidewall comprising inner surface that defines a cooling fluid plenum and a fuel plenum therein, wherein said housing sidewall comprises at least one opening extending through said sidewall inner surface;

a plurality of mixing tubes coupled in flow communication with said air plenum and extending through said housing, wherein each of said mixing tubes comprises an inner surface defining a flow channel extending between the air plenum and the combustion chamber, at least one mixing tube of said plurality of mixing tubes comprises at least one cooling fluid aperture for channeling a flow of cooling fluid from said cooling fluid plenum to said flow channel; and a cooling conduit coupled to said sidewall such that said at least one sidewall opening couples said cooling conduit in flow communication with said cooling fluid plenum for channeling a flow of cooling fluid to said cooling fluid plenum.

15. A combustor assembly in accordance with claim 14 further comprising:

an end plate coupled to an outer surface of said sidewall; and an impingement plate coupled to said sidewall outer surface and spaced outwardly from said end plate such that a first chamber is defined between said endplate and said impingement plate, said cooling conduit coupled to said impingement plate to channel a flow of cooling fluid to said first chamber and to said cooling fluid plenum.

16. A combustor assembly in accordance with claim 15, further comprising a separation wall coupled between said cooling conduit and said end plate to isolate said cooling conduit from said first chamber.

17. A combustor assembly in accordance with claim 16, wherein said separation wall comprises at least one opening extending through said separation wall to couple said cooling conduit in flow communication with said plurality of fuel nozzles.

18. A combustor assembly in accordance with claim 16, further comprising a divider wall coupled between said cooling conduit and said housing sidewall such that a second chamber is defined between said sidewall and said divider wall, said divider wall comprising at least one opening extending through said divider wall to couple said cooling conduit in flow communication with said cooling fluid plenum through said chamber.

19. A combustor assembly in accordance with claim 14, further comprising a plurality of openings extending through said aft endwall to couple said cooling fluid plenum to said combustion chamber, said plurality of openings oriented circumferentially about said at least one mixing tube.

20. A combustor assembly in accordance with claim 19, wherein said at least one mixing tube comprising a tip end that extends outwardly from said aft endwall towards said combustion chamber, wherein each of said plurality of openings is oriented at a first oblique angle with respect to said aft endwall, said mixing tube tip end comprises a tip surface that is oriented at a second oblique angle that is approximately equal to said first oblique angle.

21. A combustor assembly in accordance with claim 14, wherein said at least one mixing tube comprises an outer surface and at least one slot defined along said outer surface to couple said cooling fluid plenum in flow communication with said combustion chamber.

22. A combustor assembly in accordance with claim 14, wherein said at least one mixing tube comprises a tip end extending between an inner surface and an outer surface of said at least one mixing tube, and at least one channel extending from said outer surface towards said tip end to channel cooling fluid from said cooling fluid plenum towards the combustion chamber.

23. A method of assembling a fuel nozzle assembly for use with a turbine engine, said method comprising:

coupling a sidewall between a forward endwall and an opposite aft endwall to form a housing having an inner surface that defines a cavity therein, wherein the housing sidewall comprises at least one opening extending through the sidewall inner surface;

coupling an interior wall to the housing inner surface such that a fuel plenum is defined between the interior wall and the forward endwall, and such that a cooling fluid plenum is defined between the interior wall and the aft endwall;

coupling a plurality of mixing tubes to the housing, such that each mixing tube of the plurality of mixing tubes extends through the housing, each of the plurality of mixing tubes including an inner surface that defines a flow channel;

defining at least one cooling fluid aperture through the at least one mixing tube to couple the cooling fluid plenum in flow communication with the mixing tube flow channel; and coupling a cooling conduit to the housing sidewall such that the at least one sidewall opening couples the cooling conduit in flow communication with the cooling fluid plenum.

24. A method in accordance with claim 23, further comprising defining a plurality of openings through the aft endwall to couple the cooling fluid plenum in flow communication with the combustion chamber, wherein the plurality of openings are oriented circumferentially about the at least one mixing tube.

25. A method in accordance with claim 23, further comprising defining at least one slot along an outer surface of the at least one mixing tube to couple the cooling fluid plenum in flow communication with the combustion chamber.

26. A method in accordance with claim 23, wherein at least one mixing tube of the plurality of mixing tubes includes a tip end extending between the inner surface and an outer surface of said at least one mixing tube, said method further comprises defining at least one channel extending from the mixing tube outer surface towards the tip end to channel cooling fluid from the cooling fluid plenum towards the combustion chamber.

27. A method in accordance with claim 23, further comprising:

defining at least one opening extending through the housing sidewall; and coupling the cooling conduit to the sidewall such that the at least one sidewall opening couples the cooling conduit in flow communication with the cooling fluid plenum.

* * * * *